US005317997A

United States Patent [19]

Tomitaku

[11] Patent Number: 5,317,997

[45] Date of Patent: Jun. 7, 1994

[54] AIR INLET SYSTEM OF AN ENGINE

[75] Inventor: Eiji Tomitaku, Tokyo, Japan

[73] Assignee: Komatsu Zenoah Co., Tokyo, Japan

[21] Appl. No.: 19,569

[22] Filed: Feb. 18, 1993

[30] Foreign Application Priority Data

Dec. 3, 1992 [JP] Japan ..... 4-324028

[51] Int. Cl.[5] ..... F01P 1/02

[52] U.S. Cl. ..... 123/41.7; 55/DIG. 28; 55/337

[58] Field of Search ..... 123/41.58, 41.65, 41.66, 123/41.67, 41.7, 198 E; 55/DIG. 28, 1, 52, 199, 203

[56] References Cited

U.S. PATENT DOCUMENTS

| | | | |
|---|---|---|---|
| 4,233,043 | 11/1980 | Catterson | 123/198 E |
| 4,332,220 | 6/1982 | Itzrodt | 123/41.7 |
| 4,537,160 | 8/1985 | Shirai | 123/41.58 |
| 4,600,418 | 7/1986 | Gommel et al. | 55/DIG. 28 |
| 4,716,860 | 1/1988 | Henriksson et al. | 123/41.58 |
| 4,765,282 | 8/1988 | Nagashima | 123/41.7 |
| 4,770,130 | 9/1988 | Nagashima | 123/41.67 |
| 4,819,589 | 4/1989 | Nagashima | 123/52 M |
| 4,841,920 | 6/1989 | Andreasson et al. | 123/41.66 |

FOREIGN PATENT DOCUMENTS

| | | |
|---|---|---|
| 55-104561 | 8/1980 | Japan . |
| 60-1161 | 1/1985 | Japan . |
| 224032 | 2/1990 | Japan . |
| 224033 | 2/1990 | Japan . |
| 224060 | 2/1990 | Japan . |
| 320529 | 5/1991 | Japan . |

*Primary Examiner*—Noah P. Kamen

*Attorney, Agent, or Firm*—Sandler, Greenblum & Bernstein

[57] ABSTRACT

An air inlet system of an engine includes a fan having a plurality of vanes in a radial arrangement for blowing air from a center of rotation of the fan towards a radially outward area. A fan case covers the fan and has an airflow supply opening formed in the vicinity of the center of rotation of the fan and an airflow path formed at the outer periphery of the fan to direct an airflow for cooling said engine. A communication path has an air intake formed in the vicinity of the airflow supply opening in the fan case and directs the introduced air to a carburetor of the engine.

5 Claims, 3 Drawing Sheets

AIR INLET SYSTEM OF AN ENGINE

BACKGROUND OF THE INVENTION

This invention relates to an air inlet system of a small-sized engine for use in a portable working tool such as a chain saw, a bush cutter, and a blower fan.

FIG. 1 shows a conventional small-sized engine of the type described. A carburetor 7 is fixedly connected to an air inlet 3 of an engine cylinder 1 through a heat insulator pipe 5. A suction port 9 of the carburetor 7 communicates with an atmosphere through a filter 11. In a chain saw, for example, the suction port 9 of the carburetor 7 communicates with an atmosphere through a gap between a handle 13 and a carburetor cover 15, or a gap between a fuel tank 17 integral with the handle 13 and the carburetor 7.

Generally, a portable working tool often produces dust such as chips, sawdust, and sand dust. In the conventional engine, air is directly sucked from an atmosphere into the carburetor 7 through the filter. In this event, the sucked air inevitably contains a large amount of dust which is stuffed into the filter. This requires frequent cleaning of the filter. Thus, maintenance of the filter is troublesome.

SUMMARY OF THE INVENTION

It is an object of this invention to reduce stuffing of a filter by removing dust, which is contained in air to be sucked into a carburetor, by means of centrifugal force and to thereby facilitate maintenance including cleaning of the filter.

It is another object of this invention to prevent accumulation of dust by discharging dust adhered to a communication path, a carburetor unit, a filter or the like by reversing a suction stream every time when a throttle valve is operated to provide idle rotation during running, In order to accomplish the above-mentioned objects, this invention provides an air inlet system of an engine, comprising:

a fan having a plurality of vanes in a radial arrangement for blowing air from a center of rotation of the fan towards a radially outward area;

a fan case covering the fan and having an airflow supply opening formed in the vicinity of the center of rotation of the fan and an airflow path formed at the outer periphery of the fan to direct an airflow for cooling the engine; and a communication path having an air intake formed in the vicinity of the airflow supply opening in the fan case, the communication path being for directing the introduced air to a carburetor of the engine.

According to this invention, while the engine is rotated, air with dust is sucked through the airflow supply opening into the fan case. The air enters from the airflow supply opening along an axial direction and is then turned along the vanes to travel outwardly in a radial direction perpendicular to the axial direction. Due to centrifugal force (inertial force) generated upon this change in direction, the dust flows along a side wall opposite to the air intake of the carburetor. Accordingly, little dust remains in the air around the air intake. Thus, only a reduced amount of dust is contained in the air sucked through the air intake into the carburetor.

During running, the air intake is kept at a negative pressure but suction force of the engine is stronger. Accordingly, a part of the air introduced through the airflow supply opening is sucked through the air intake into the carburetor. Instantaneously when the throttle lever is switched to an idle position in order to provide idle rotation, the throttle valve of the carburetor is closed. In this event, in the communication path extending to a suction port of the carburetor, suction force of the blower fan becomes greater than the suction force of the engine because the rotation of the blower fan is maintained by the inertial force. The air in the communication path instantaneously flows backwardly towards the air intake to thereby discharge dust adhered to the inside of the communication path through the air intake into the airflow of the blower fan.

DESCRIPTION OF THE PREFERRED EMBODIMENT

Now, description will be made as regards an embodiment of this invention with reference to the drawings.

Figure 1:
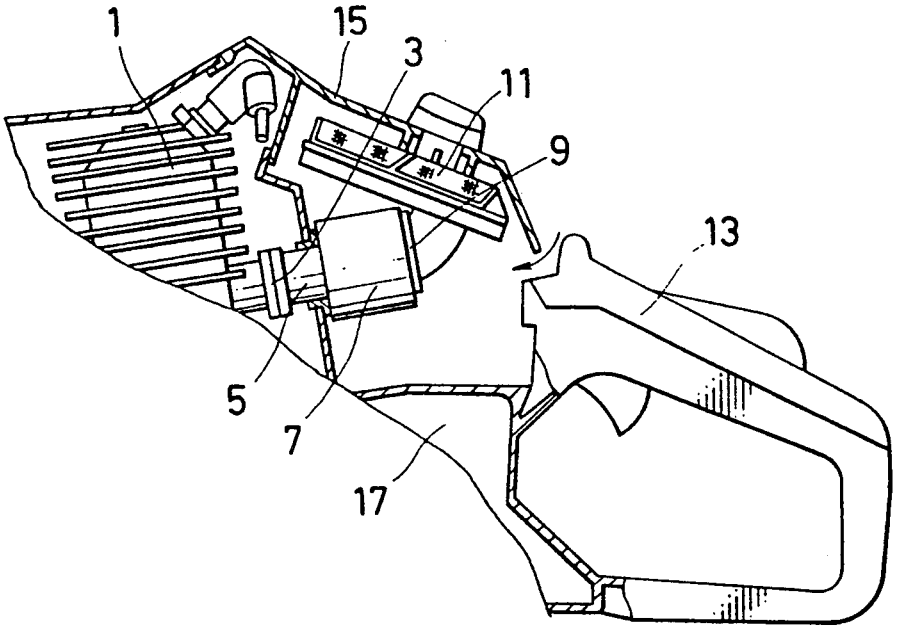
FIG.1 PRIOR ART
FIG. 1 is a sectional view of an air inlet system of a conventional engine.
Figure 2:
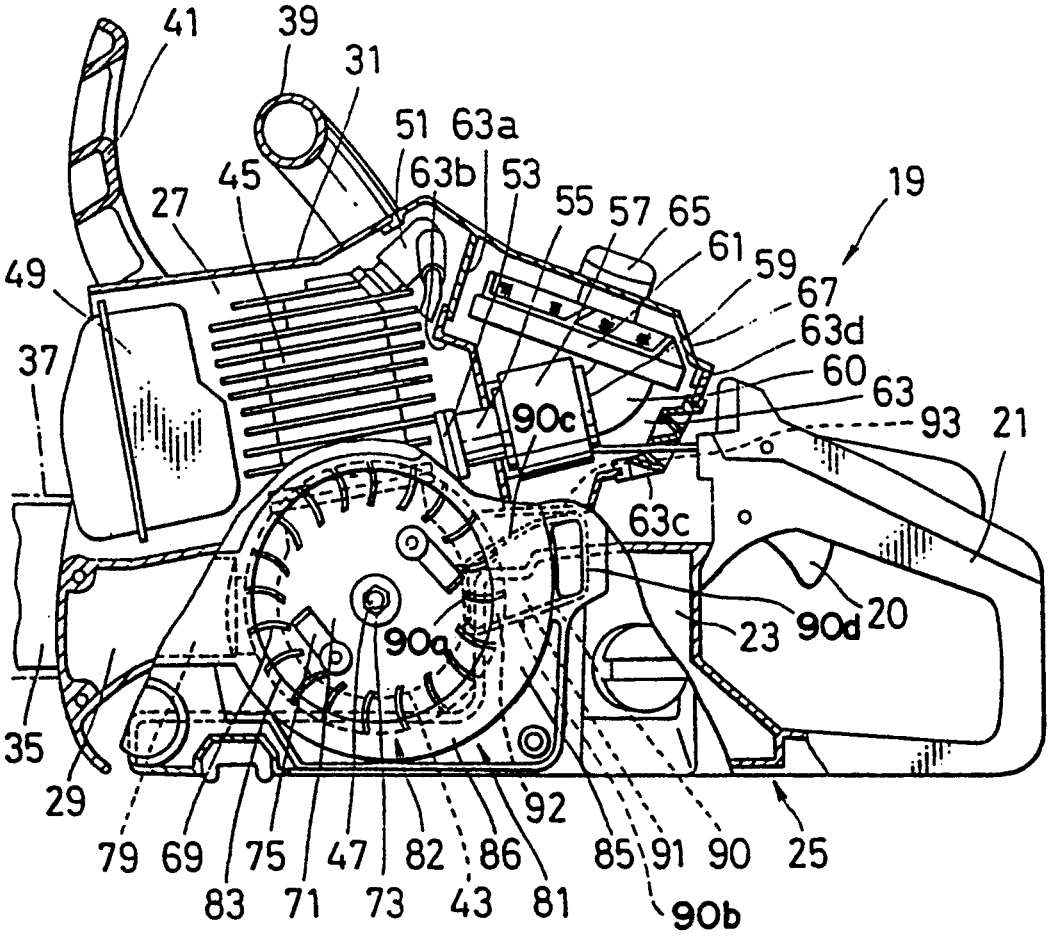
FIG. 2 is a sectional view of an air inlet system of an engine according to this invention.
Figure 3:
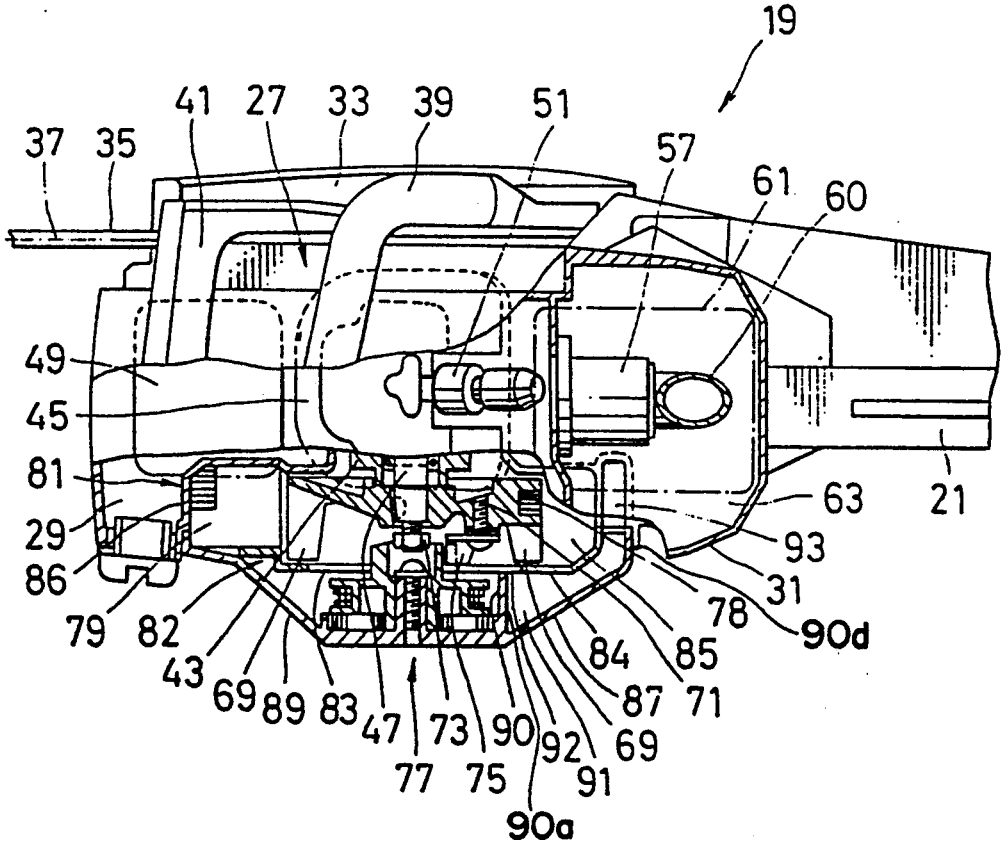
FIG. 3 is a partially-sectional plan view of the air inlet system of the engine illustrated in FIG. 2.

FIGS. 2 and 3 shows a chain saw 19 using the system according to this invention. The chain saw 19 has a support 25 comprising a combination of a rear handle 21 with a throttle lever 20 and a fuel tank 23 formed in an integral fashion. An engine case 31 is attached to the support 25 through a vibration isolator (not shown) made of rubber. The engine case 31 contains an engine 27. A lubricant tank 29 is integrally formed inside of the engine case 31. A guide bar 35 is fixed between the engine case 31 and a side cover 33 secured onto a right side surface of the engine case 31. A saw chain 37 is engaged with the outer perimeter of the guide bar 35 and is driven by the engine 27 to rotate along the outer perimeter of the guide bar 35. The saw chain 37 is provided with a cutting blade portion and an engagement member formed outwardly and inwardly of the chain, respectively. The engagement member is engaged with a guide groove formed in the outer perimeter of the guide bar 35. A front handle 39 is attached at both ends thereof to the support 25 and extends over the engine case 31 from the right side through the upper front portion to the left side. A guard 41 is pivotally supported on the upper front portion of the engine case 31 to be swingable. The guard 41 serves to protect a hand of an operator who holds the front handle 39. When the guard 41 is forwardly swinged, the engine 27 is stopped by an emergency stop mechanism.

A crank case 43 is fixed to the engine case 31. A cylinder 45 of the engine 27 is fixed to the upper part of the crank case 43. A crank shaft 47 is axially supported on the crank case 43 and extends in a leftward direction. A muffler 49 and an ignition plug 51 are attached to the front side and the upper side of the cylinder 45, respectively. A carburetor 57 is fixed through a heat insulator pipe 55 to an air inlet 53 formed at the rear side of the cylinder 45. A filter 61 is fixed to a suction port 59 of the carburetor 57 through a path 60. A carburetor housing 63 is sealingly formed in the engine case 31 and accommodates the carburetor 57 and the filter 61. The upper part of the carburetor housing 63 is covered by a carburetor housing cover 67 removably attached to the filter 61 through a screw 65. A sealed space is formed by walls 63*a*, 63*b*, 63*c*, and 63*d* of the carburetor housing 63 and the carburetor housing cover 67.

A rotary member (fan) 71 is fixed to the left end of the crank shaft 47 through a nut 73. The rotary member 71 is provided, on its left side surface, with vanes 69 in a radial arrangement. The rotary member 71 is releasably coupled to a recoil starter 77 through a centrifugal one-way clutch 75. An electromagnetic coil 79 energized in response to a magnet 78 embedded in the rotary member 71 is fixed to the engine case 31 in the vicinity of the outer periphery of the rotary member 71. A blower fan 82 is formed by a combination of the rotary member 71, the vanes 69, and a fan case 81. The fan case 81 covers the rotary member 71 and the vanes 69. The fan case 81 comprises an airflow supply cover 84 and a fan case body 86. The airflow supply cover 84 has, at its lefthand center area, an airflow supply opening 83 communicating with an atmosphere. The fan case body 86 has a centrifugal airflow path 85 at its outer periphery. The airflow path 85 communicates with the outer periphery of the cylinder 45. A cover 87 is removably attached to the engine case 31 and supports the recoil starter 77. The cover 87 has an airflow orifice 89 for communication between an atmosphere and the airflow supply opening 83. Between the fan case 81 and the cover 87, a partition wall 90 is arranged to define a communication path 91. The partition wall 90 is formed by four walls 90*a*, 90*b*, 90*c*, and 90*d*. The partition wall 90 is fixed to the cover 87. The communication path 91 communicates with the airflow path 85 through an air intake 92 which is defined by wall 90*a*. The air intake 92 is formed in a left side wall of the fan case 81 and extends from the lateral side of the vanes 69 to a position nearer to the center. Other end of the communication path 91 communicates with an opening 93 formed in a bottom surface of the carburetor housing 63. The opening 93 is formed at the bottom of the wall 63*b* of the carburetor housing 63. The cover 87 is removably attached to the engine case 31.

In operation, the operator holds the front handle 39 and the rear handle 21 with one hand and the other hand, respectively. Cutting operation of a tree or the like is carried out by the saw chain 37 which is driven by the engine 27 to rotate along the outer perimeter of the guide bar 35. The air is sucked by the vanes 69 rotating with the rotary member 71 and flows from the airflow orifice 89 through the airflow supply opening 83 along an axial direction. Then, the air is turned in a radial direction and delivered through the airflow path 85 at the outer periphery of the fan case 81 towards the outer periphery of the cylinder 45 to cool the cylinder 45.

A part of the airflow is sucked by the suction force of the engine 27 from the airflow path 85 through the air intake 92, the communication path 91, the opening 93, the carburetor housing 63, the filter 61, the carburetor 57, the air inlet 53 into the cylinder 45. The dust such as sawdust and sand dust contained in the air entering through the airflow supply opening 83 is moved towards the side opposite to the air intake 92 by the centrifugal force (inertial force) when the air entering from the airflow supply opening 83 along the axial direction is turned in the radial direction. Specifically, the dust entering along the axial direction continues to travel in the same direction due to the inertial force. The dust flows along the wall located inwardly in the axial direction and enters in the airflow path 85. Thereafter, the dust reaches an area around the cylinder 45. Accordingly, only a reduced amount of dust is left in the sucked air sucked through the air intake 92 adjacent to the airflow supply opening 83. Thus, it is possible to suppress stuffing of the filter 61 of the carburetor 57.

When the throttle lever 20 is operated to provide idle rotation during running, the throttle valve of the carburetor 57 is instantaneously closed. The suction force of the vanes 69 becomes greater than the suction force of the engine 27 in the communication path 91 because the rotation of the vanes 69 is maintained by the inertial force. Accordingly, the air in the communication path 91 instantaneously flows backwardly towards the air intake 92 to thereby discharge dust adhered to the filter 61, the carburetor housing 63, the communication path 91, and so on through the air intake 92 into the airflow of the blower fan 82. Every time when the idle rotation is provided, the dust in the filter 61, the carburetor housing 63, and the communication path 91 is discharged. Thus, cleaning is carried out.

What is claimed is:

1. An air inlet system of an engine, comprising:

a fan having a plurality of vanes in a radial arrangement for blowing air from a center of rotation of said fan towards a radially outward area;

a fan case covering said fan and having an airflow supply opening formed in the vicinity of the center of rotation of said fan so as to propel sucked air in a first axial direction and an airflow path formed at the outer periphery of said fan to direct an airflow for cooling said engine; and a communication path having an air intake formed in the vicinity of said airflow supply opening in said fan case so as to guide a part of the sucked air in a second axial direction which is reverse to the first axial direction, said communication path directing introduced air to a carburetor of said engine.

2. An air inlet system of an engine, comprising:

a fan having a plurality of vanes in a radial arrangement for blowing air from a center of rotation of said fan towards a radially outward area;

a fan case covering said fan and having an airflow supply opening formed in the vicinity of the center of rotation of said fan and an airflow path formed at the outer periphery of said fan to direct an airflow for cooling said engine;

a communication path having an air intake formed in the vicinity of said airflow supply opening in said fan case, said communication path directing introduced air to a carburetor of said engine; and a cover for covering an outer path of said fan case, said cover having a first wall portion defining said communication path and a second wall portion partitioning a part of said airflow supply opening to define said air intake.

3. An air inlet system of an engine, comprising:

a sealed housing containing a carburetor of said engine;

a fan having a plurality of vanes in a radial arrangement for blowing air from a center of rotation of said fan towards a radially outward area;

a fan case covering said fan and having an airflow supply opening formed in the vicinity of the center of rotation of said fan so as to propel sucked air in a first axial direction and an airflow path formed at the outer periphery of said fan to direct an airflow for cooling said engine; and a communication path having an air intake formed in the vicinity of said airflow supply opening in said fan case so as to guide a part of the sucked air in a second axial direction which is reverse to the first axial direction and communicating with said sealed housing.

4. An air inlet system of an engine, comprising:

a sealed housing containing a carburetor of said engine;

a fan having a plurality of vanes in a radial arrangement for blowing air from a center of rotation of said fan towards a radially outward area;

a fan case covering said fan and having an airflow supply opening formed in the vicinity of the center of rotation of said fan and an airflow path formed at the outer periphery of said fan to direct an airflow for cooling said engine;

a communication path having an air intake formed in the vicinity of said airflow supply opening in said fan case and communicating with sealed housing; and a cover for covering an outer part of said fan case, said cover having a first wall portion defining said communication path and a second wall portion partitioning a part of said airflow supply opening.

5. An air inlet system of an engine, comprising:

an engine case containing said engine and having a sealed housing containing a carburetor of said engine;

a fan having a plurality of vanes in a radial arrangement and fixed to a crank shaft of said engine, said fan blowing air from a center of rotation towards a radially outward area;

a fan case covering said fan, said fan case having an airflow supply opening formed in the vicinity of the center of rotation of said fan, said fan case having an airflow path formed at the outer periphery of said fan to direct an airflow for cooling said engine; and a cover covering an outer part of said fan case and having a first wall portion defining a communication path communicating with said sealed housing, and a second wall portion defining an air intake in the vicinity of said airflow supply opening within said fan case.

* * * * *